US011178989B2

(12) United States Patent
Friesel

(10) Patent No.: US 11,178,989 B2
(45) Date of Patent: Nov. 23, 2021

(54) GARMENT HANGER AND GARMENTS INCLUDING A HANGER

(71) Applicant: Nisson Friesel, Spring Valley, NY (US)

(72) Inventor: Nisson Friesel, Spring Valley, NY (US)

( * ) Notice: Subject to any disclaimer, the term of this patent is extended or adjusted under 35 U.S.C. 154(b) by 0 days.

(21) Appl. No.: 16/520,465

(22) Filed: Jul. 24, 2019

(65) Prior Publication Data

US 2021/0022533 A1 Jan. 28, 2021

(51) Int. Cl.
*A47G 25/38* (2006.01)
*A45F 5/02* (2006.01)

(52) U.S. Cl.
CPC ..... *A47G 25/38* (2013.01); *A45F 5/02* (2013.01)

(58) Field of Classification Search
CPC ..... A47G 25/38; A47G 25/14; A47G 25/54; A45F 5/02; A45F 2005/023; A41D 27/22; A45C 13/18; A45C 3/004; A45C 13/03; B65D 33/14; B65D 23/005; B65D 73/0064
USPC ..... 223/88; 2/256, 271; 224/584; 206/284, 206/285, 288, 289, 290, 291; 383/22, 23
See application file for complete search history.

(56) References Cited

U.S. PATENT DOCUMENTS 222,259 A * 12/1879 England ..... A41D 27/22 2/271
306,248 A * 10/1884 Harris ..... A41D 27/22 2/271
599,777 A * 3/1898 Fuerchtinger ..... A41D 27/22 2/271
710,773 A * 10/1902 Gordon ..... A41D 27/22 2/271
899,929 A * 9/1908 Van Nortwick ..... A41D 27/22 2/271
1,022,504 A * 4/1912 Raughtigan ..... A41D 27/22 2/271
1,312,553 A * 8/1919 Limbach ..... A41D 27/22 2/271
2,613,858 A * 10/1952 Sprague ..... A47G 25/4053 223/94
7,058,988 B1 * 6/2006 Zahner ..... A41D 27/22 2/271
10,842,209 B2 * 11/2020 Kennedy ..... A41D 27/20
2017/0245567 A1 8/2017 Fathollahi et al.

OTHER PUBLICATIONS

TUMI—Alpha 3 Garment Cover—1 Dress or Suit Bag for Men and Women—black. Retrieved from Amazon.com: https://www.amazon.com/gp/product/B07MMMJP31/ref=as_li_ti?ie=UTF8&tag=tigarmentbags-20&camp=1789&creative=9325&link [accessed May 2, 2019].

(Continued)

*Primary Examiner* — F Griffin Hall
(74) *Attorney, Agent, or Firm* — Michael J. Feigin, Esq.; Feigin and Fridman LLC

(57) ABSTRACT

A garment hanger, adapted to be attached to a portion of a garment. The garment hanger includes a rigid hanging hook fixedly attached to a hanger connection portion, which hanger connection portion is adapted to be attached to the portion of the garment. The hanger connection portion may be sewn to the garment or removably attached thereto with fasteners. The hanger connection portion may include first and second garment supporting extensions fixedly attached to the hanger connection portion and extending outwardly therefrom.

1 Claim, 7 Drawing Sheets

(56) References Cited

OTHER PUBLICATIONS

Ever Noticed the Small Loop At The Back Of Your Shirt? It's Not for What You Think It Is. Retrieved from Scoopwhoop.com: https://www.scoopwhoop.com/what-the-loop-behind-your-shirt-does/#.t8z9djnor [accessed May 9, 2019].

* cited by examiner

GARMENT HANGER AND GARMENTS INCLUDING A HANGER

FIELD OF THE DISCLOSED TECHNOLOGY

The disclosed technology relates generally to garment care. More specifically, the disclosed technology relates to garment hangers that can be permanently or temporarily attached to a garment for hanging thereof.

BACKGROUND OF THE DISCLOSED TECHNOLOGY

Typically, garments are hung on wood, metal, or plastic hangers, which terminate in a rigid hook. Such hangers are bulky and hard to store when they are not in use or simply are unavailable in all places or venues may run out of available hangers.

However, the ability to hang clothes up in a closet, for example while traveling, is important to maintaining the quality and appearance of the clothes, and to prevent the clothes from being creased or harmed in another way.

There is thus a need in the art to be able to properly hang a garment anywhere.

SUMMARY OF THE DISCLOSED TECHNOLOGY

The disclosed technology relates generally to garment care. More specifically, the disclosed technology relates to garment hangers that can be permanently or temporarily attached to a garment for hanging thereof.

According to an aspect of some embodiments of the teachings herein, there is provided a garment hanger, adapted to be attached to a portion of a garment, the garment hanger including a rigid hanging hook fixedly attached to a hanger connection portion, which hanger connection portion is adapted to be attached to the portion of the garment.

In some embodiments, the rigid hanging hook is fixedly attached to the hanger connection portion via a flexible connection strap.

In some embodiments, the garment hanger includes first and second garment supporting extensions fixedly attached to the hanger connection portion and extending outwardly therefrom. The first and second garment supporting extensions are adapted to engage and to support shoulder portions of the garment when the garment is hanging.

In some embodiments, the rigid hanging hook is rotatable relative to the hanger connection portion.

In some embodiments, the hanger connection portion includes an elongate flexible body having a first set of fasteners disposed at a first end thereof and a second set of corresponding fasteners disposed at a second end thereof, opposite to the first end. The hanger connection portion is adapted to be removably attached to the garment by the elongate flexible body being disposed around a hanging tab of the garment and engagement of the first set of fasteners with the second corresponding set of fasteners.

In some embodiments, the rigid hanging hook extends from a first lateral side of the hanger connection portion, and a second rigid hanging hook extends from a second lateral side of the hanger connection portion, opposite the first lateral side. At least one of the rigid hanging hook and the second rigid hanging hook may be rotatable relative to the hanger connection portion.

According to another aspect of some embodiments of the teachings herein, there is provided a garment having the hanger connection portion of a garment hanger as disclosed herein attached to an interior surface of the garment, such that the garment is adapted to be hanged by engaging the rigid hanging hook with a hanging rod.

In some such embodiments, the hanger connection portion of the garment hanger is sewn to the interior surface. In other embodiments, the hanger connection portion includes a first set of fasteners, the interior surface of the garment includes a second set of corresponding fasteners. In such embodiments, the hanger connection portion is removably and reversibly connected to the garment by connection of the first set of fasteners to the second set of fasteners.

In some embodiments, the garment includes a hanging tab sewn therein. In such embodiments, the hanger connection portion may includes an elongate flexible body having a first set of fasteners disposed at a first end thereof and a second set of corresponding fasteners disposed at a second end thereof, opposite to the first end. The hanger connection portion may be removably attached to the garment by the elongate flexible body being disposed around the hanging tab and engagement of the first set of fasteners with the second corresponding set of fasteners.

In some embodiments, the rigid hanging hook is fixedly attached to the hanger connection portion via a flexible connection strap. In some such embodiments, in a hanging orientation of the garment hanger, the rigid hanging hook extends out of the garment for hanging thereof, and in a wearing orientation of the garment hanger, the rigid hanging hook is folded over and is disposed against the interior surface of the garment. As such, in the wearing orientation the rigid hanging hook does not extend out of the garment and is not visible when the garment is worn. In some such embodiments, the garment further includes a pocket in the interior surface thereof, such that, in the wearing orientation of the garment hanger the rigid hanging hook is disposed within the pocket.

In some embodiments, the garment hanger further includes first and second garment supporting extensions fixedly attached to the hanger connection portion and extending outwardly therefrom. The first and second garment supporting extensions are disposed within shoulder portions of the garment to support the shoulder portions when the garment is hanging.

In some embodiments, the rigid hanging hook of the garment hanger is rotatable relative to the hanger connection portion of the garment hanger.

In some embodiments, the rigid hanging hook extends from a first lateral side of the hanger connection portion towards a top edge of the garment, and a second rigid hanging hook extends from a second lateral side of the hanger connection portion towards a bottom edge of the garment. At least one of the rigid hanging hook and the second rigid hanging hook may be rotatable relative to the hanger connection portion.

According to another aspect of some embodiments of the teachings herein, there is provided a garment including a garment body having an interior surface. A hanger connection portion is attached to the interior surface of the garment body. The hanger connection portion includes a first connector extending outwardly therefrom toward a top edge of the garment. A rigid hanging hook terminates at one end thereof in a second connector, and is reversible connectable to the hanger connection portion by engagement of the first and second connectors. In some such embodiments, the first and second connectors include corresponding threaded connectors.

In the context of the present specification and claims, the term "garment" relates to any article of clothing adapted to be worn by a person or an animal, as well as to other hanging textile items including garment bags, towels, curtains, and the like.

In the context of the present application and claims, the "top" and "bottom" of a garment relate to the orientation of the garment when worn. As such, the top of the garment would be the portion of the garment disposed highest on a person's body, when worn, and the bottom of the garment would be the portion of the garment disposed lowest on the person's body, when worn.

DETAILED DESCRIPTION OF EMBODIMENTS OF THE DISCLOSED TECHNOLOGY

In an embodiment of the disclosed technology, a garment hanger is adapted to be attached to a portion of a garment. Garment hanger includes a rigid hanging hook attached to a hanger connection portion, which hanger connection portion is adapted to be attached to the portion of the garment. In some embodiments, the rigid hanging hook is fixedly attached to the hanger connection portion, while in other embodiments it is removably attached to the hanger connection portion. In some embodiments, the hanger connection portion is fixedly attached to the garment, for example by sewing of the hanger connection portion onto a surface of the garment, whereas in other embodiments the hanger connection portion is removably attached to the garment, for example by suitable fasteners.

Embodiments of the disclosed technology will become clearer in view of the following description of the drawings.

Figure 1A:
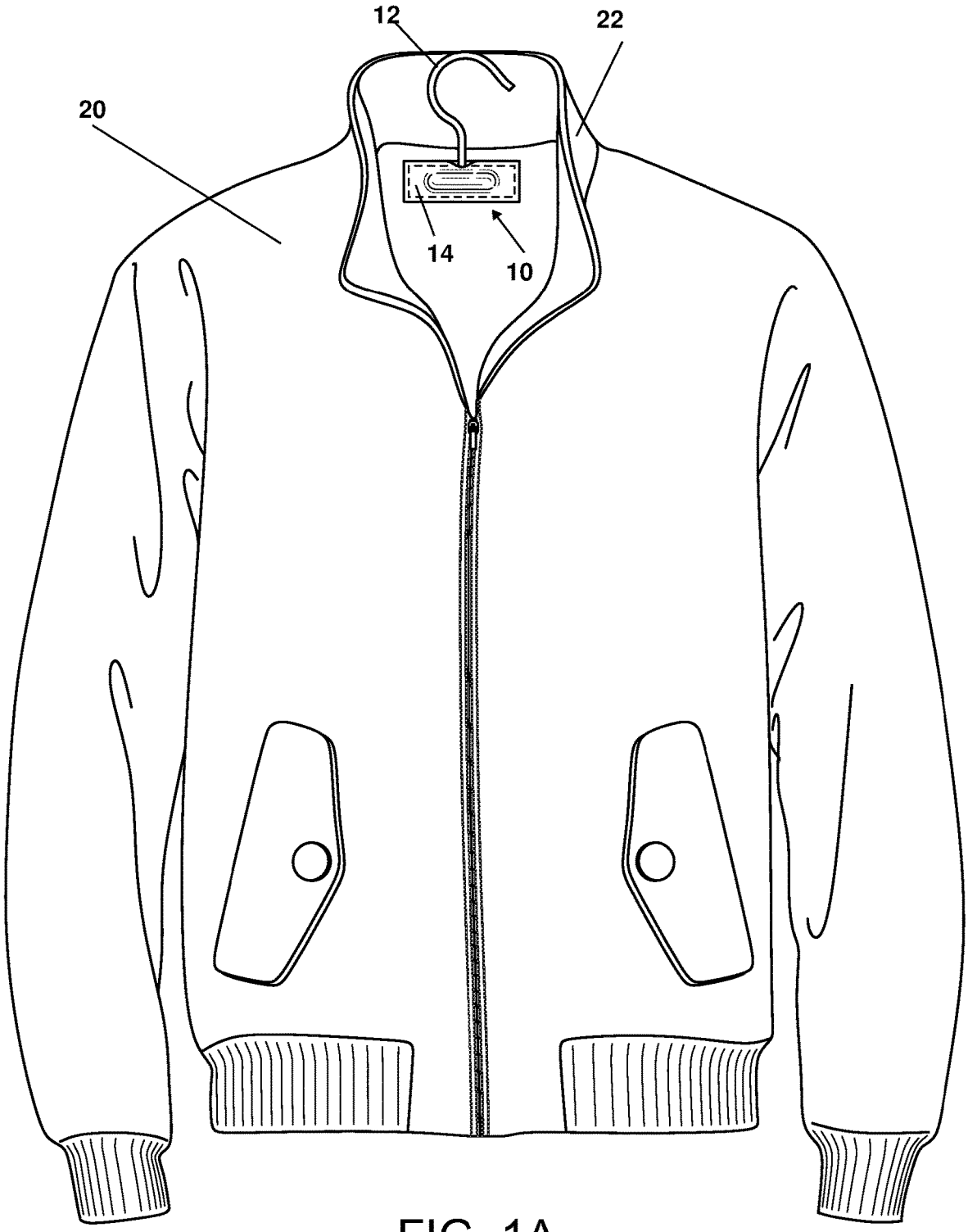
FIGS. 1A, 1B, and 1C are schematic illustrations of garments including garment hangers, according to an embodiment of the disclosed technology.
Figure 1B:
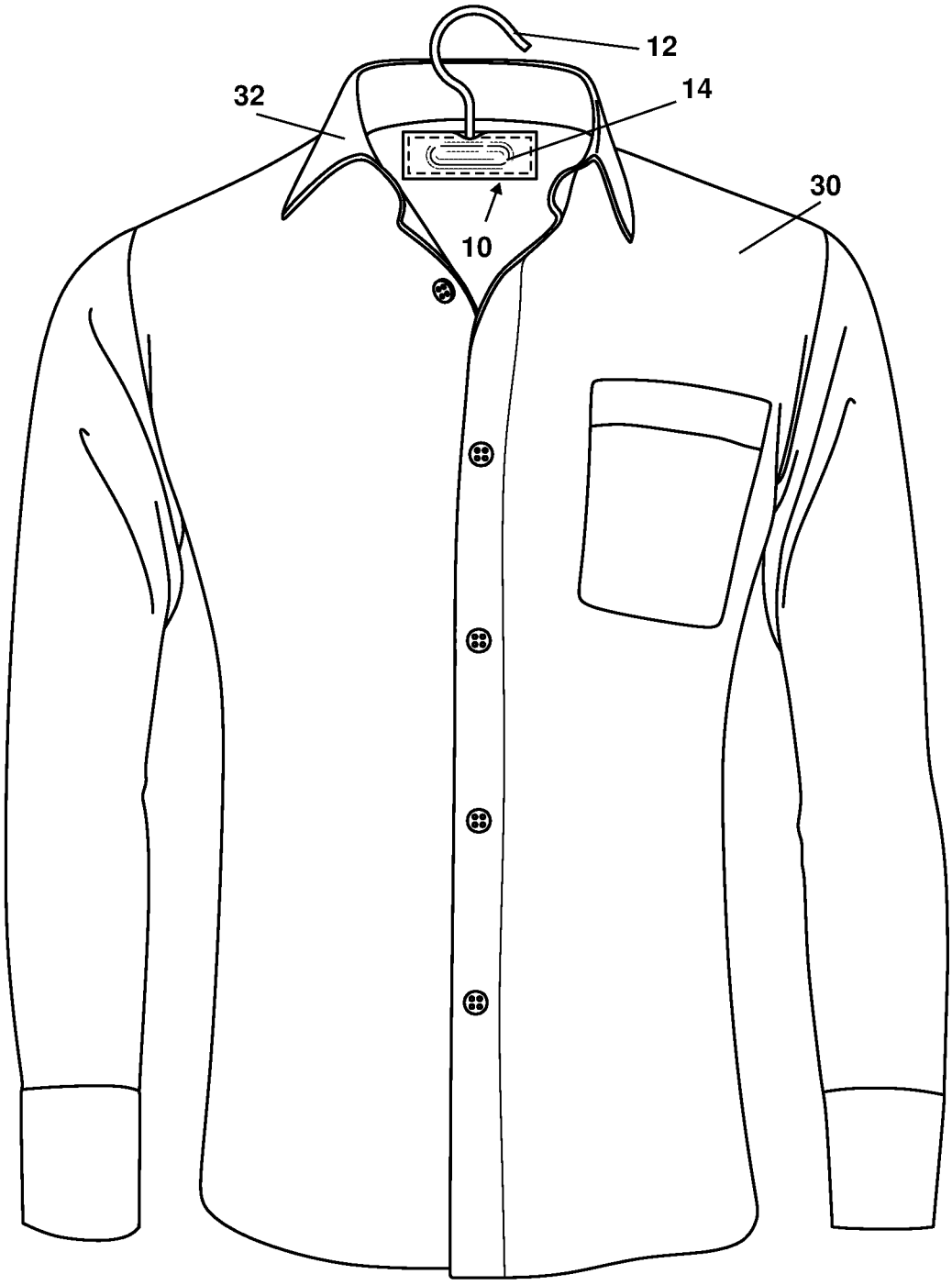
Figure 1C:
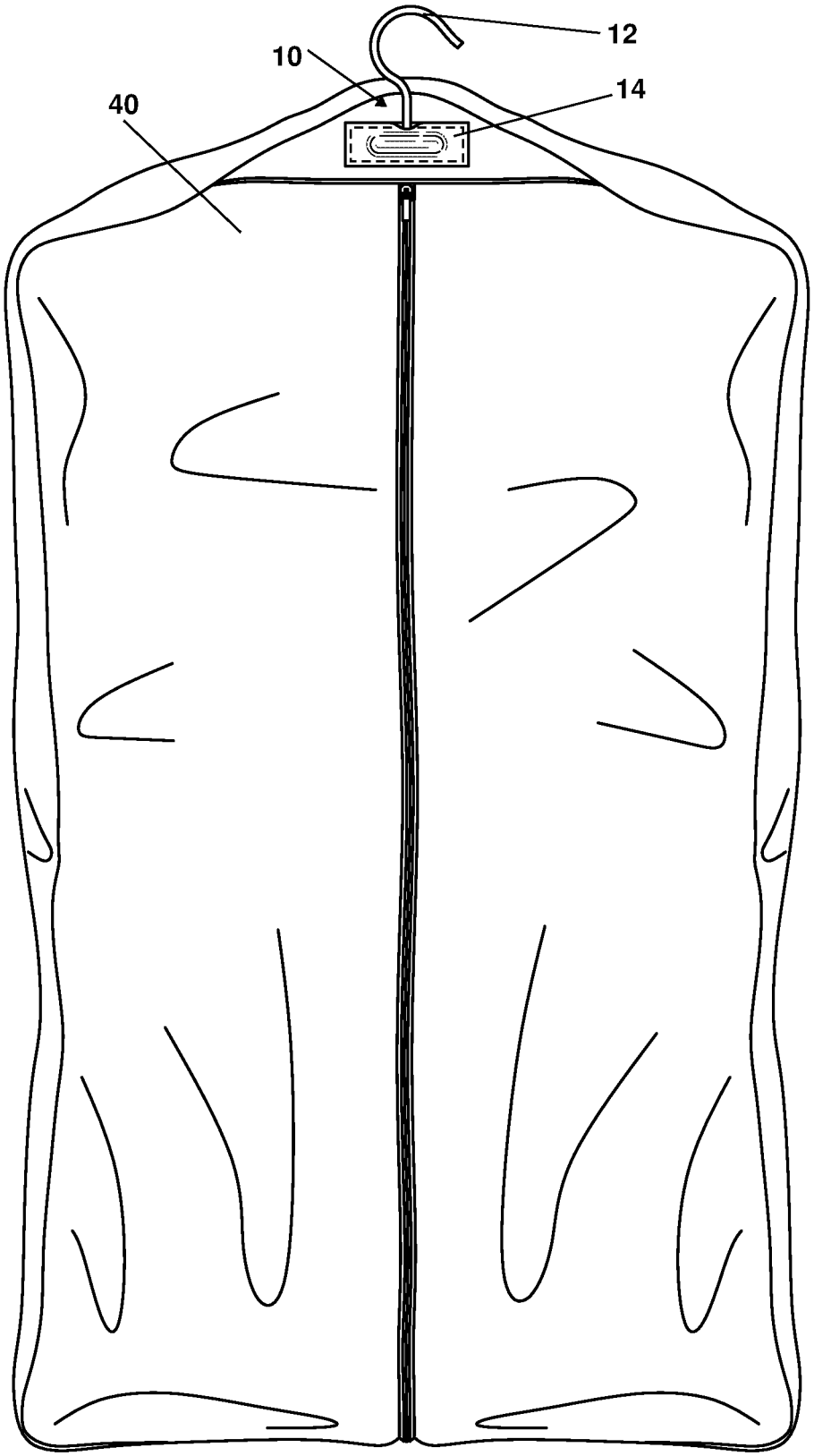

FIGS. 1A, 1B, and 1C are schematic illustrations of garments including garment hangers, according to an embodiment of the disclosed technology. As seen in FIG. 1A, a garment hanger 10, includes a rigid hanging hook 12 fixedly attached to a hanger connection portion 14. The hanger connection portion 14 is sewn to a top portion of a jacket 20, near a collar 22 thereof, such that rigid hanging hook 12 extends upwards toward a top edge of the jacket 20.

FIG. 1B shows the garment hanger 10, such that hanger connection portion is sewn to a top portion of a shirt 30, near a collar 32 thereof. In the embodiment of FIG. 1B, the rigid hanging hook 12 extends upwards from the hanger connection portion 14 towards and past the top edge of shirt 30.

FIG. 1C shows the garment hanger 10, such that hanger connection portion is sewn to a top portion of a garment bag 40, such that rigid hanging hook 12 extends upwards from the hanger connection portion 14 towards and past the top edge of garment bag 40.

Although FIGS. 1A to 1C show the garment hanger 10 disposed at the top edge of the garment, the garment hanger may be disposed at any suitable location along the garment. For example, in some embodiments when hanging a towel, the garment hanger 10 would be disposed at the center of the towel such that the body of the towel drapes around the garment hanger.

Although in the embodiments of FIGS. 1A to 1C the hanger connection portion 14 is fixedly attached to the garment by being sewn thereto, in some embodiments the hanger connection portion 14 is reversibly and removably attached to the garment. For example, the garment may include a first set of fasteners and the hanger connection portion 14 may include a second, corresponding set of fasteners, such that the garment hanger 10 may be attached to the garment by engagement of the first and second sets of fasteners. For example, the first set of fasteners may include one side of a hook and loop strip, such as Velcro®, and the second set of fasteners may include the opposing side of the hook and loop strip. As other examples, the fasteners may include snaps, hook-and-eye arrangements, buttons, zippers, and the like.

Figure 2A:
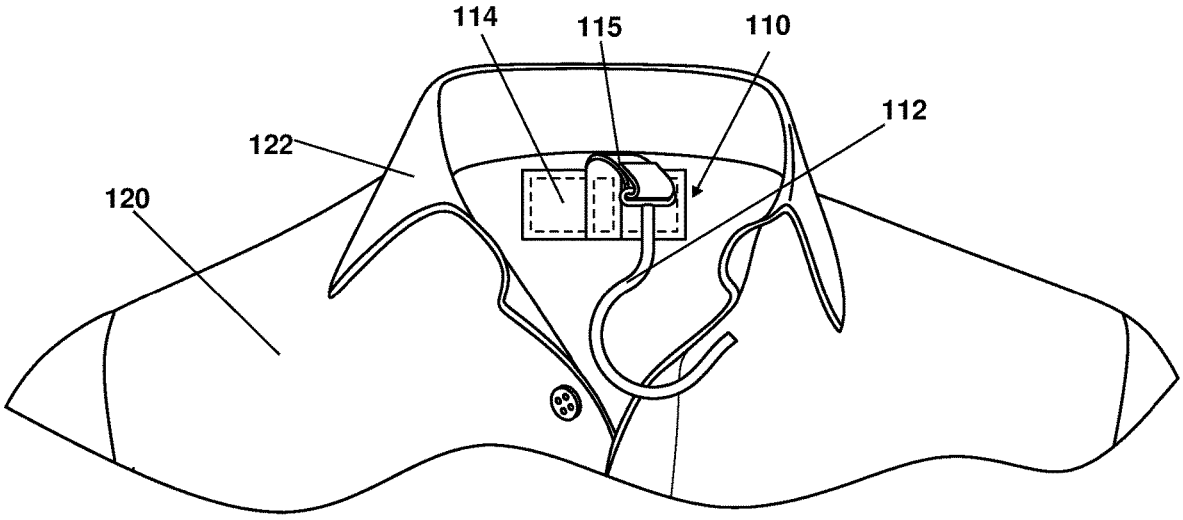
FIGS. 2A and 2B show a garment including a garment hanger, in a wearing orientation and in a hanging orientation, respectively, according to an embodiment of the disclosed technology.
Figure 2B:
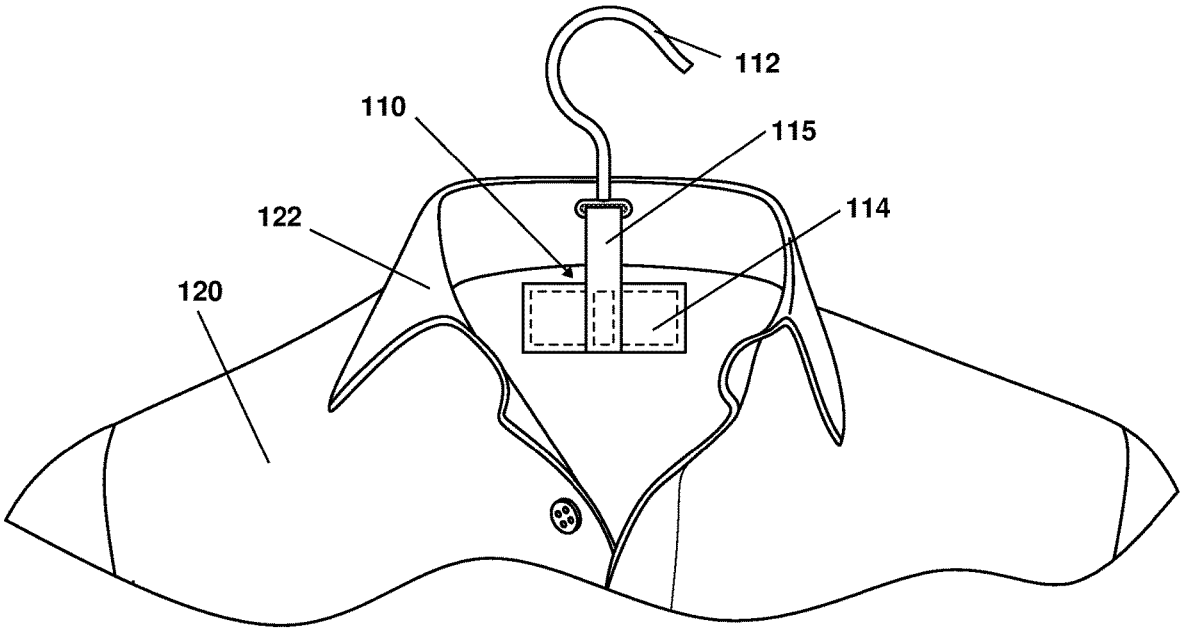

FIGS. 2A and 2B show a garment including a garment hanger 110, in a wearing orientation and in a hanging orientation, respectively, according to an embodiment of the disclosed technology. Specifically, garment hanger 110 includes a rigid hanging hook 112, a hanger connection portion 114, and a flexible strap 115 connecting the rigid hanging hook 112 to the hanger connection portion 114. The hanger connection portion 114 is attached to an inner surface of a garment, here shown as a shirt 120, at the top portion thereof close to a collar 122 of the shirt. As discussed hereinabove, the hanger connection portion 114 may be fixedly attached to the shirt 120, for example by sewing, as illustrated in FIGS. 2A and 2B, or maybe removably attached thereto, for example by fasteners.

As seen in FIG. 2A, in a wearing orientation of garment hanger 110, rigid hanging hook 112, together with flexible strap 115, is folded downward such that the rigid hanging hook 112 is disposed below the hanger connection portion 114, and lies adjacent the inner surface of shirt 120. In this orientation, when shirt 120 is worn by a user, the garment hanger 110 does not extend beyond the top edge of the shirt 120, and is not visible outside the garment when the garment is worn. In the hanging orientation, illustrated in FIG. 2B, the rigid hanging hook 112 extends upwards from hanger connection portion 114 and beyond the top edge of shirt 120, to facilitate hanging of the shirt.

Figure 3:
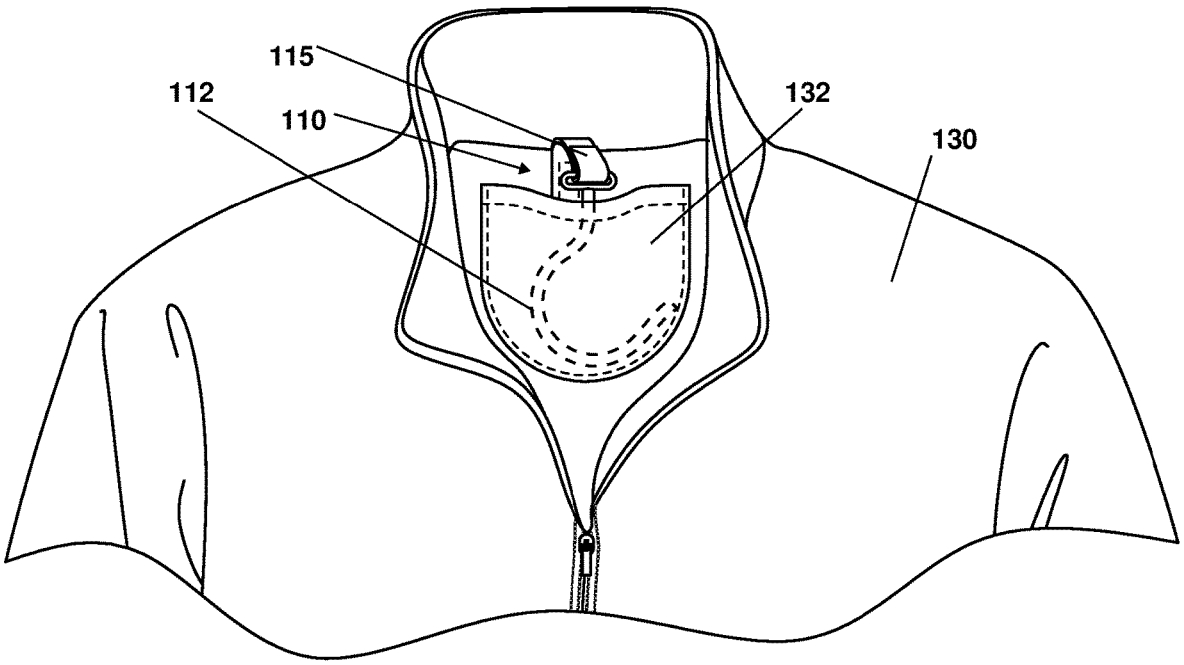
FIG. 3 shows the garment hanger of FIGS. 2A and 2B, stored in a pocket while in the wearing orientation, according to an embodiment of the disclosed technology.

As seen in FIG. 3, in some embodiments, a garment 130 may have an internal pocket 132 therein, typically close to the collar or top edge of the garment. In such embodiments, in the wearing orientation of garment hanger 110, the rigid hanging hook 112 may be placed within internal pocket 132, thereby preventing the rigid hanging hook 112 from engaging, irritating and/or chaffing the skin of the user.

Figure 4:
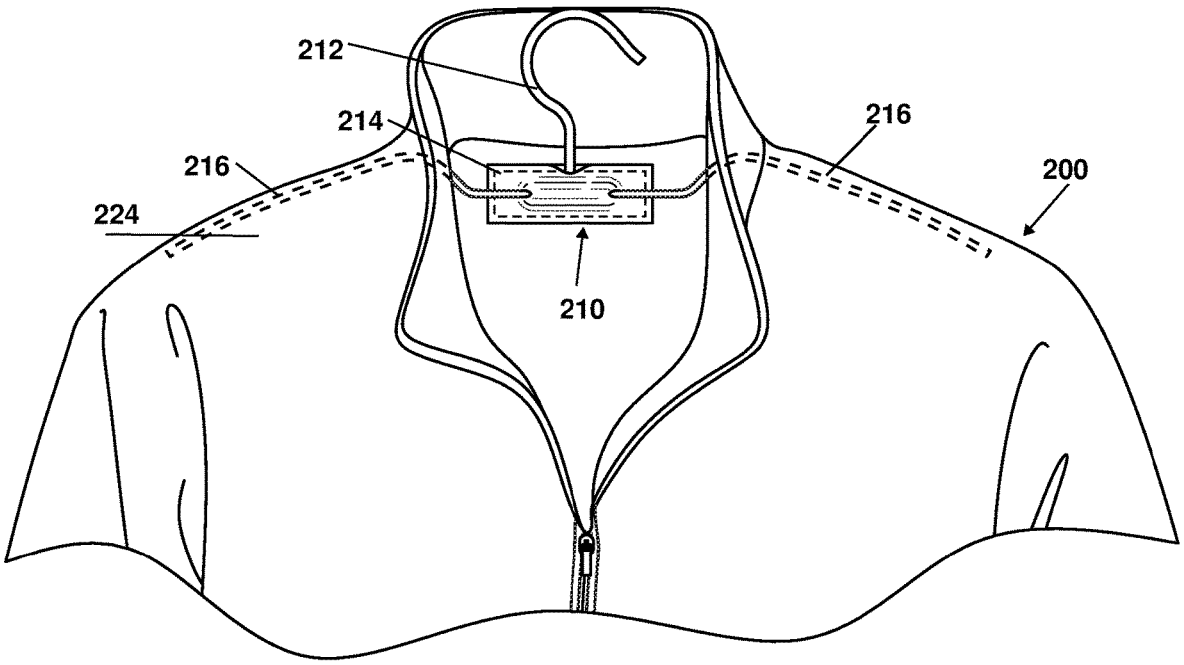
FIG. 4 shows a garment having garment hanger including garment supporting extensions, according to an embodiment of the disclosed technology.

FIG. 4 shows a garment 200 having garment hanger 210 attached thereto. Garment hanger 210 includes a rigid hanging hook 212 and a hanger connection portion 214 substantially as described hereinabove, and additionally includes garment supporting extensions 216 attached to hanger connection portion 214 and extending outwardly therefrom. The garment supporting extensions 216 may be fixedly attached to the hanger connection portion 214, or may be removably attached thereto. As seen in FIG. 4, in use, the garment supporting extensions 216 are disposed within garment 200, for example within shoulder portions 224 thereof, to support the garment and prevent it from drooping or wrinkling while the garment is hanging.

Figure 5:
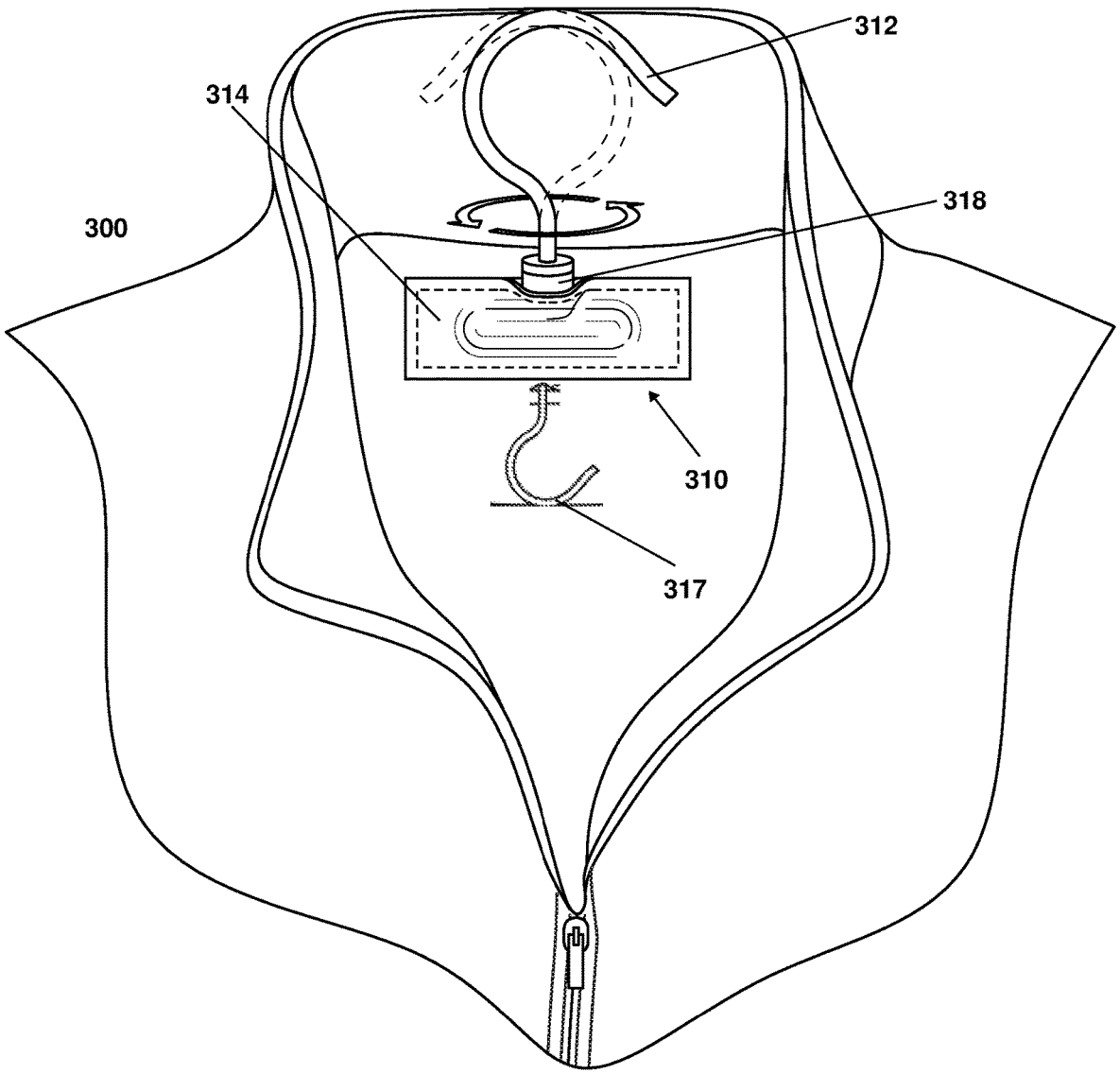
FIG. 5 shows a garment having a garment hanger which includes a secondary hanger for hanging of another item, according to an embodiment of the disclosed technology.

FIG. 5 shows a garment 300 having a garment hanger 310 attached thereto. The garment hanger 310 includes a rigid hanging hook 312 and a hanger connection portion 314 attached to a surface of the garment, substantially as described hereinabove. As seen in FIG. 5, the garment hanger 310 further includes a secondary rigid hanging hook 317, for example adapted to hold a purse, belt, or another item when the garment is hanging.

As shown in FIG. 5, in some embodiments, the rigid hanging hook 312 may be rotatable relative to hanger connection portion 314. In some such embodiments, the rigid hanging hook 312 may be removably and reversibly attached to the hanger connection portion. In such embodiments, hanger connection portion 314 may include a first connector 318 extending outwardly therefrom toward the top edge of garment 300, and rigid hanging hook 312 may include a second connector, corresponding to the first connector. As such, the rigid hanging hook 312 is removably and reversibly connectable to the hanger connection portion 314 by engagement of the first and second connectors. For example, the first connector 318 may be internally threaded, and the second connector may be externally threaded, such that rotation of the rigid hanging hook relative to hanger connection portion 314 results in threaded engagement of the hook 312 and first connector 318, thereby connecting the hook to the garment.

Figure 6A:
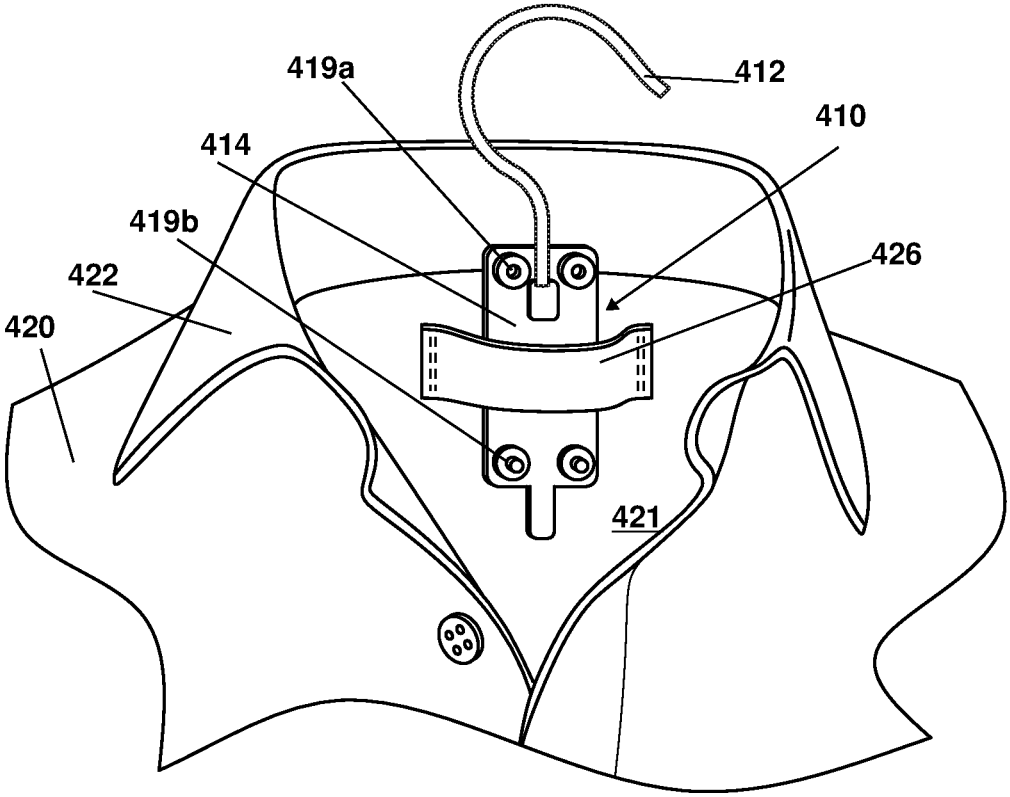
FIGS. 6A and 6B show a removable garment hanger attached to a garment using fasteners, according to an embodiment of the disclosed technology, in an attachment orientation and in an attached orientation, respectively.
Figure 6B:
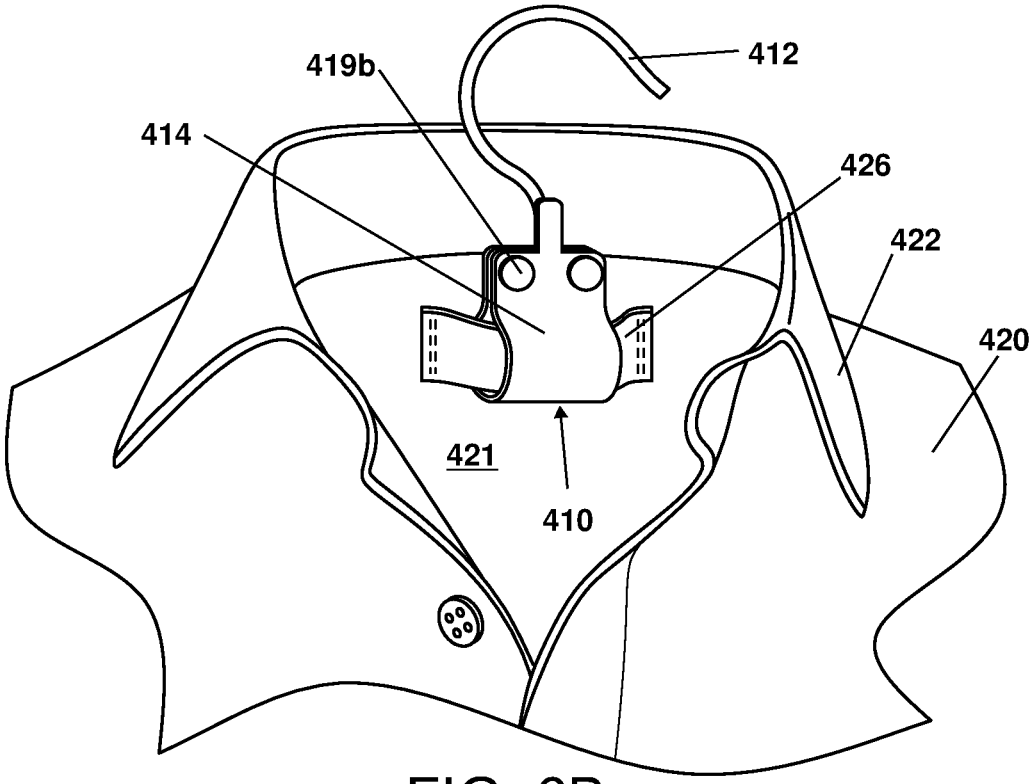

FIGS. 6A and 6B show a removable garment hanger 410 attached to a garment 420, in an attachment orientation and in an attached orientation, respectively. The removable garment hanger 410 includes a rigid hanging hook 412, and a hanger connection portion 414 formed of an elongate flexible body. A first set of fasteners 419*a* is disposed at a first end of hanger connection portion 414, and a second corresponding set of fasteners 419*b* is disposed at a second, opposing end of hanger connection portion 414.

The garment 420 includes a body portion having an inner surface 421 and terminating at a top end thereof in collar 422. A hanging tab 426 is attached to inner surface 421 adjacent the base of collar 422. During attachment of the garment hanger 410 to the garment the hanger connection portion 414 is placed between inner surface 421 and hanging tab 426 of the garment 420, such that fasteners 419*a* are on one side of the tab 426, and fasteners 419*b* are on the opposing side of the tab 426, as shown in FIG. 6A. Fasteners 419*a* and 419*b* are then attached to each other, as illustrated in FIG. 6B, thereby to attach the hanger connection portion 414, and the garment hanger 410, to the garment 400.

Although the fasteners 419*a* and 419*b* are illustrated in FIGS. 6A and 6B as snaps, any suitable type of fasteners may be used, and are considered within the scope of the present invention, including hook-and-loop strips (e.g. Velcro®), hook-and-eye arrangements, buttons, zippers, and the like.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A garment hanger, adapted to be attached to a portion of a garment, the garment hanger comprising a rigid hanging hook fixedly attached to a hanger connection portion, which hanger connection portion is adapted to be attached to the portion of the garment;

wherein said garment hanger is attached to an interior surface of said garment, such that said garment is adapted to be hanged by engaging said rigid hanging hook with a hanging rod;

wherein said garment includes a hanging tab sewn therein;

wherein said hanger connection portion comprises an elongate flexible body having a first set of fasteners disposed at a first end thereof and a second set of corresponding fasteners disposed at a second end thereof, opposite to said first end; and wherein said hanger connection portion is removably attached to said garment by said elongate flexible body being disposed around said hanging tab and engagement of said first set of fasteners with said second set of corresponding fasteners.

* * * * *